US011001990B2

(12) United States Patent
Fukuda et al.

(10) Patent No.: US 11,001,990 B2
(45) Date of Patent: May 11, 2021

(54) WORKING MACHINE

(71) Applicant: KUBOTA CORPORATION, Osaka (JP)

(72) Inventors: Yuji Fukuda, Osaka (JP); Keigo Honda, Osaka (JP); Takahiro Usami, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 16/703,072

(22) Filed: Dec. 4, 2019

(65) Prior Publication Data

US 2020/0208376 A1 Jul. 2, 2020

(30) Foreign Application Priority Data

Dec. 28, 2018 (JP) ..... JP2018-248506

(51) Int. Cl.
*E02F 9/22* (2006.01)
*F15B 21/0427* (2019.01)
(Continued)

(52) U.S. Cl.
CPC ..... *E02F 9/2267* (2013.01); *E02F 9/2275* (2013.01); *E02F 9/2292* (2013.01);
(Continued)

(58) Field of Classification Search
CPC ..... E02F 9/2285; E02F 9/2267; E02F 9/0875; F15B 2211/6355
See application file for complete search history.

(56) References Cited

U.S. PATENT DOCUMENTS 8,342,789 B2 * 1/2013 Yasuda ..... E02F 9/0816 414/686
8,495,870 B2 * 7/2013 Sumiyoshi ..... E02F 9/2235 60/444
(Continued)

FOREIGN PATENT DOCUMENTS

JP 10281114 A * 10/1998
JP 2001355612 A * 12/2001
JP 2009-287281 A 12/2009

OTHER PUBLICATIONS

JP H10281114 A machine translation to English from espacenet (Year: 1998).*
(Continued)

*Primary Examiner* — Thomas E Lazo
*Assistant Examiner* — Michael Quandt
(74) *Attorney, Agent, or Firm* — Greenblum & Bernstein, P.L.C.

(57) ABSTRACT

A working machine includes a branched tube connected to a branched portion branching from an operation fluid tube, a plurality of input tubes connected to the second actuator valves, a plurality of output tubes connected to a pressure receiver portion of the second hydraulic device, a main tube connected to the third actuator valve, and a relay device, and the relay device includes a plurality of input ports connected to the plurality of input tubes, a plurality of output ports connected to the plurality of output tubes, a plurality of first flow lines connecting between the plurality of input ports and the plurality of input ports, a main port connected to the main tube, a branched port connected to the branched tube, and a second flow line arranged between the plurality of first fluid lines to connect between the main port and the branched port.

20 Claims, 7 Drawing Sheets

(51) Int. Cl.
*E02F 9/08* (2006.01)
*E02F 9/20* (2006.01)

(52) U.S. Cl.
CPC ..... *E02F 9/0875* (2013.01); *E02F 9/2083* (2013.01); *E02F 9/2221* (2013.01); *E02F 9/2253* (2013.01); *E02F 9/2285* (2013.01); *F15B 21/0427* (2019.01); *F15B 2211/20546* (2013.01); *F15B 2211/20576* (2013.01); *F15B 2211/355* (2013.01); *F15B 2211/62* (2013.01); *F15B 2211/6355* (2013.01); *F15B 2211/7058* (2013.01); *F15B 2211/715* (2013.01); *F15B 2211/851* (2013.01)

(56) References Cited

U.S. PATENT DOCUMENTS 9,080,312 B2 * 7/2015 Takaura ..... F16H 61/421
9,328,757 B2 * 5/2016 Horii ..... E02F 9/2292

OTHER PUBLICATIONS

JP 2001355612 A machine translation to English from espacenet (Year: 2001).*

* cited by examiner

WORKING MACHINE

CROSS-REFERENCE TO RELATED APPLICATIONS

The present application claims priority under 35 U.S.C. § 119 to Japanese Patent Application No. P2018-248506, filed Dec. 28, 2018. The content of this application is incorporated herein by reference in their entirety.

BACKGROUND OF THE INVENTION

Field of the Invention

The present invention relates to a working machine such as a skid steer loader, a compact track loader, a backhoe.

Description of Related Art

A working machine disclosed in Japanese Unexamined Patent Application No. 2009-287281 is previously known. The working machine disclosed in Japanese Unexamined Patent Application No. 2009-287281 includes a hydraulic actuator (a bucket cylinder, a boom cylinder) to be driven by operation fluid, a plurality of control valves (working control valves) that is configured to control the hydraulic actuator, a plurality of pilot valves (working operation levers) configured to adjust the pilot fluid that is operation fluid, a plurality of first tube members (working pilot hoses) in which the pilot fluid outputted from the plurality of pilot valves flows, the first tube members being connected to each of the plurality of pilot valves, a plurality of second tube members (working pilot hoses) connected respectively to pressure-receiving portions of the plurality of control valves, and a relay device respectively connecting between the plurality of first tube members and the plurality of second tube members.

SUMMARY OF THE INVENTION

A working machine includes: a pilot pump to output pilot fluid; a first hydraulic device to which the pilot fluid is supplied; a first actuator valve to control the pilot fluid to be supplied to the first hydraulic device; a second hydraulic device to which the pilot fluid is supplied; a plurality of second actuator valves to control the pilot fluid to be supplied to the second hydraulic device; a third actuator valve arranged in an output fluid tube connecting between the pilot pump and the plurality of second actuator valve; an actuator fluid tube connecting between the first hydraulic device and the first actuator valve; a branched tube connected to a branched portion branching from the actuator fluid tube; a plurality of input tubes in which the pilot fluid outputted from the plurality of second actuator valves flows, the input tubes being connected to the second actuator valves; a plurality of output tubes connected to a pressure receiver portion of the second hydraulic device; a main tube connected to the third actuator valve; a relay device including: a plurality of input ports connected to the plurality of input tubes; a plurality of output ports connected to the plurality of output tubes; a plurality of first flow paths connecting between the plurality of input ports and the plurality of input ports; a main port connected to the main tube; a branched port connected to the branched tube; and a second flow path arranged between the plurality of first fluid paths to connect between the main port and the branched port.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
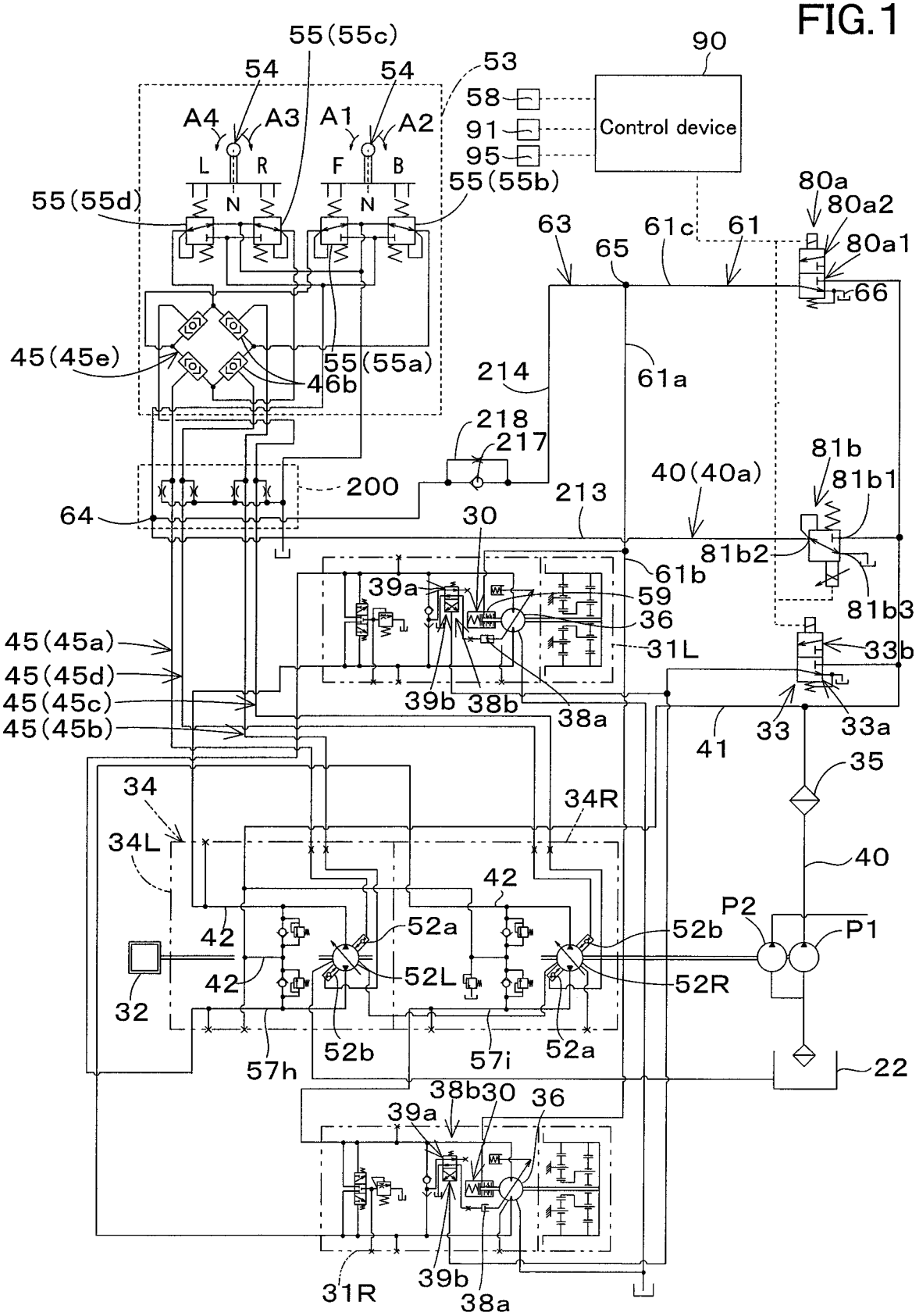
FIG. 1 is a schematic view illustrating a hydraulic system for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Hereinafter, an embodiment of the present invention will be described with reference to the drawings.

Hereinafter, an embodiment of a hydraulic system of working machine 1 concerning the present invention is described, referring to drawings suitably.

Figure 7:
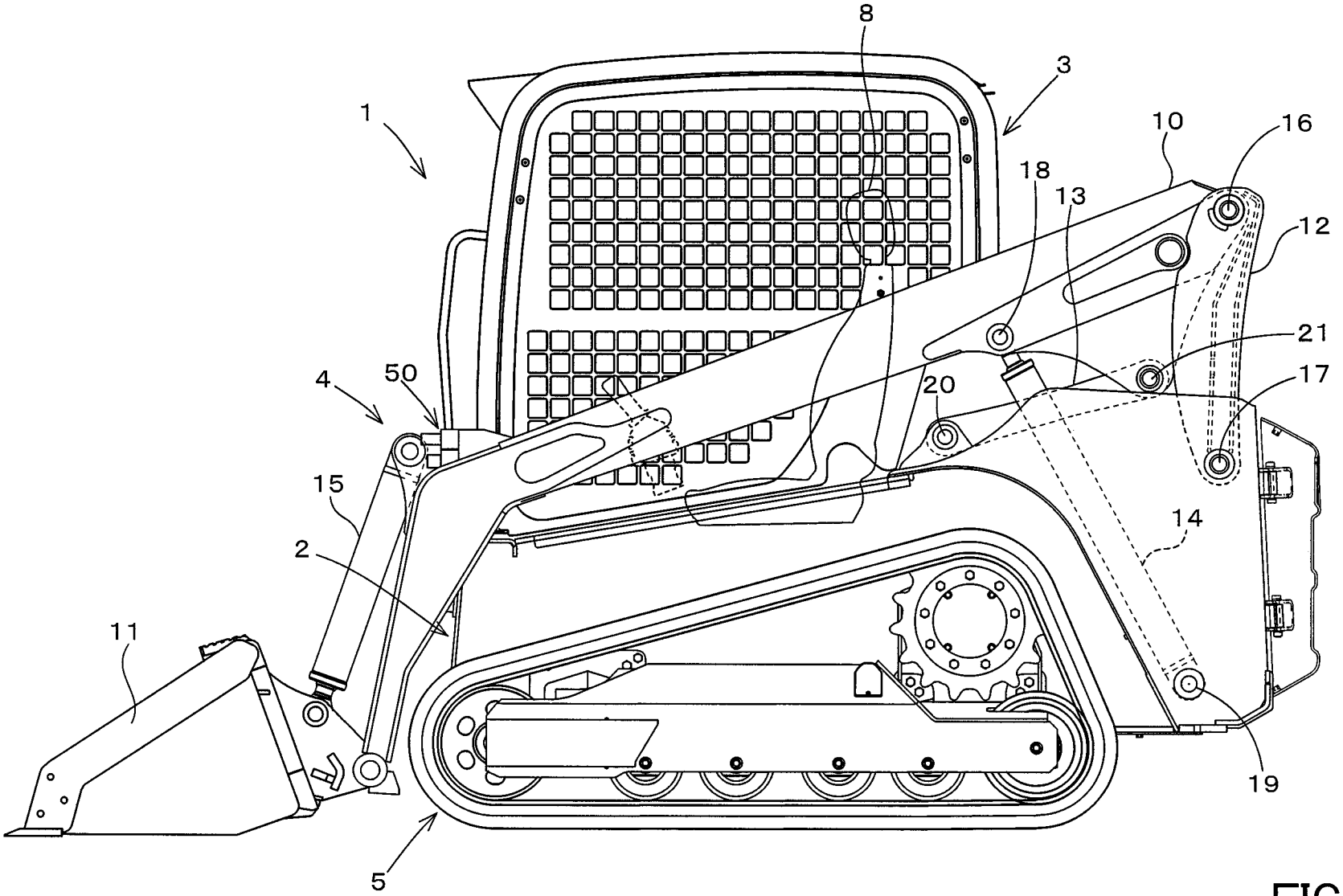
FIG. 7 is a view illustrating a left side surface of the working machine according to the embodiment.

FIG. 7 shows a side view of the working machine 1 according to the present invention. FIG. 7 shows a compact truck loader as an example of the working machine 1. However, the working machine 1 according to the present invention is not limited to a compact truck loader, and may be another type of loader working machine such as a skid steer loader. Moreover, the working machine 1 other than the loader working machine may be used.

As shown in FIG. 7, the working machine 1 includes a machine body 2, a cabin 3, a work device 4, and a traveling device 5.

In the embodiment of the present invention, the front side (left side in FIG. 7) of the driver seated on the driver's seat 8 of the working machine 1 is front, the rear side (right side in FIG. 7) is rear, the left side of the driver (the front side in FIG. 7) is left, and the right side of the driver (the back side in FIG. 7) is right. The horizontal direction, which is a direction orthogonal to the front-rear direction, will be described as the body width direction.

The direction from the central part of the body 2 toward the right part or the left part will be described as the outside of the body. In other words, the outward direction of the body is the direction of the body width and away from the body 2. The direction opposite to the outside of the body will be described as the inside of the body. In other words, the in-machine direction is the width direction of the machine body and the direction approaching the machine body 2.

The cabin 3 is mounted on the body 2. The cabin 3 is provided with a driver's seat 8. The work device 4 is attached to the machine body 2. The traveling device 5 is provided outside the body 2. A prime mover 32 is mounted at the rear of the machine body.

The work device 4 includes a boom 10, a work tool 11, a lift link 12, a control link 13, a boom cylinder 14, and a bucket cylinder 15.

The boom 10 is provided on the right and left sides of the cabin 3 so as to be swingable up and down. The work tool 11 is, for example, a bucket, and the bucket 11 is provided at the tip (front end) of the boom 10 so as to be swingable up and down.

The lift link 12 and the control link 13 support the base part (rear part) of the boom 10 so that the boom 10 can swing up and down. The boom cylinder 14 raises and lowers the boom 10 by expanding and contracting. The bucket cylinder 15 swings the bucket 11 by expanding and contracting.

The lift link 12, the control link 13, and the boom cylinder 14 are respectively provided on the left side and the right side of the body 2 corresponding to the left and right booms 10.

The lift link 12 is provided in the longitudinal direction at the rear of the base of each boom 10. The upper portion (one end side) of the lift link 12 is pivotally supported around the horizontal axis via a pivot shaft 16 (first pivot shaft) near the rear portion of the base of each boom 10.

In addition, the lower portion (the other end side) of the lift link 12 is pivotally supported around the horizontal axis via a pivot shaft 17 (second pivot shaft) near the rear portion of the machine body 2. The second pivot shaft 17 is provided below the first pivot shaft 16.

The upper part of the boom cylinder 14 is pivotally supported about a horizontal axis via a pivot shaft 18 (third pivot shaft). The third pivot shaft 18 is a base portion of each boom 10 and is provided at the front portion of the base portion. The lower part of the boom cylinder 14 is pivotally supported around a horizontal axis via a pivot shaft 19 (fourth pivot shaft). The fourth pivot shaft 19 is provided near the lower part of the rear part of the machine body 2 and below the third pivot shaft 18.

The control link 13 is provided in front of the lift link 12. One end of the control link 13 is pivotally supported about a horizontal axis via a pivot shaft 20 (fifth pivot shaft). The fifth pivot shaft 20 is the body 2 and is provided at a position corresponding to the front of the lift link 12.

The other end of the control link 13 is pivotally supported about a horizontal axis via a pivot shaft 21 (sixth pivot shaft). The sixth pivot shaft 21 is the boom 10 and is provided in front of the second pivot shaft 17 and above the second pivot shaft 17.

By expanding and contracting the boom cylinder 14, each boom 10 swings up and down around the first pivot shaft 16 while the base of each boom 10 is supported by the lift link 12 and the control link 13, and the tip of each boom 10 is moved up and down. The control link 13 swings up and down around the fifth pivot shaft 20 as each boom 10 swings up and down. The lift link 12 swings back and forth around the second pivot shaft 17 as the control link 13 swings up and down.

Another work tool 11 can be attached to the front portion of the boom 10 instead of the bucket 11. Another work tool 11 is an attachment (preliminary attachment) such as a hydraulic crusher, a hydraulic breaker, an angle bloom, an earth auger, a pallet fork, a sweeper, a mower, and a snow blower.

A connecting member 50 is provided at the front of the left boom 10. The connection member 50 is a device that connects the hydraulic equipment equipped in the preliminary attachment to the first pipe material such as a pipe provided in the boom 10. In particular, the first pipe member can be connected to one end of the connecting member 50, and the second pipe member connected to the hydraulic device of the preliminary attachment can be connected to the other end. Thereby, the operation fluid flowing through the first pipe material passes through the second pipe material and is supplied to the hydraulic equipment.

The bucket cylinder 15 is arranged near the front part of each boom 10. By expanding and contracting the bucket cylinder 15, the bucket 11 is swung.

In the present embodiment, the left and right traveling devices 5 are crawler type (including semi-crawler type) traveling devices 5. In addition, you may employ|adopt the wheel-type traveling apparatus 5 which has a front wheel and a rear wheel.

Next, the hydraulic system of the working machine 1 according to the present invention will be described. The hydraulic system of the working machine 1 has a hydraulic system. In the hydraulic system, the pipe material is a pipe (hose), a joint or the like, and the fluid tube is a passage through which oil composed of the pipe material or the like flows.

As shown in FIG. 1, the hydraulic system is a system that drives the traveling device 5, and includes a prime mover 32, a first hydraulic pump (pilot pump) P1, a first traveling motor mechanism 31L, and a second traveling motor mechanism. 31R and the traveling driving mechanism 34 are provided.

The prime mover 32 includes an electric motor, an engine, and the like. In this embodiment, the prime mover 32 is an engine. The first hydraulic pump P1 is a pump that is driven by the power of the prime mover 32, and is constituted by a constant capacity type gear pump. The first hydraulic pump P1 can discharge operation fluid stored in a tank (operation fluid tank) 22. A output fluid tube 40 through which operation fluid flows is provided on the discharge side of the first hydraulic pump P1.

A filter 35 is provided in the middle of the output fluid tube 40. The operation fluid discharge side of the output fluid tube 40 is branched into a plurality. A first charge fluid tube 41 is connected to the discharge side of the output fluid tube 40. The first charge fluid tube 41 reaches the traveling driving mechanism 34. Of the operation fluid discharged from the first hydraulic pump P1, the operation fluid used for control may be referred to as pilot fluid, and the pilot fluid pressure may be referred to as pilot pressure.

The traveling driving mechanism 34 is a mechanism that drives the first traveling motor mechanism 31L and the second traveling motor mechanism 31R, and includes a drive circuit (left drive circuit) 34L for driving the first traveling motor mechanism 31L and a drive circuit (right drive circuit) 34R for driving the second traveling motor mechanism 31R.

The drive circuits 34L and 34R have HST pumps (traveling pumps) 52L and 52R, speed change fluid tubes 57*h* and 57*i*, and a second charge fluid tube 42, respectively. The speed change fluid tubes 57*h* and 57*i* are fluid tubes connecting the HST pumps 52L and 52R and the HST motor 36.

The second charge fluid tube 42 is a fluid tube that is connected to the transmission fluid tubes 57*h* and 57*i* and replenishes the operation fluid from the first hydraulic pump P1 to the transmission fluid tubes 57*h* and 57*i*. The HST pumps 52L and 52R are swash plate type variable displacement axial pumps driven by the power of the prime mover 32.

The HST pumps 52L and 52R have a forward-traveling pressure receiving portion 52*a* to which a pilot pressure acts and a backward-traveling pressure receiving portion 52*b*, and the angle of the swash plate is changed by the pilot pressure acting on the pressure receiving portions 52*a* and 52*b*. By changing the angle of the swash plate, the output of the HST pumps 52L and 52R (discharge amount of hydraulic fluid) and the discharge direction of hydraulic fluid can be changed.

In other words, the HST pumps 52L and 52R change the driving force output to the traveling device 5 by changing the angle of the swash plate.

The first traveling motor mechanism 31L is a mechanism that transmits the power to the drive shaft of the traveling device 5 provided on the left side of the machine body 2. The second traveling motor mechanism 31R is a mechanism that transmits the power to the drive shaft of the traveling device 5 provided on the right side of the body 2. The first traveling motor mechanism 31L includes an HST motor (a traveling motor) 36 and a speed changing mechanism (a transmission mechanism).

The HST motor 36 is a variable displacement axial motor of swash plate type that is configured to change the vehicle speed (the revolving) between the first speed and the second speed. In other words, the HST motor 36 is a motor configured to change the thrust force of the working machine 1.

The transmission mechanism includes a swash plate switching cylinder 38*a* and a switching valve 38*b*. The swash plate switching cylinder 38*a* is a cylinder configured to stretched and shortened to change the angle of the swash plate of the HST motor 36.

The switching valve 38*b* is a valve configured to stretch and shorten the swash plate switching cylinder 38*a* to one side or the other side, that is, a two-position switching valve configured to be switched between the first position 39*a* and the second position 39*b*. The switching of the switching valve 38*b* is performed by the shift switching valve 33.

The shift switching valve 33 is connected to the output fluid tube 40 and is connected to the switching valve 38*b* of the first traveling motor mechanism 31L and to the switching valve 38*b* of the second traveling motor mechanism 31R. The shift switching valve 33 is a two-position switching valve configured to be switched between the first position 33*a* and the second position 33*b*.

When the shift switching valve 33 is set to be in the first position 33*a*, the pressure of the operation fluid acting on the switching valve 38*b* is set to a pressure (a deceleration pressure) corresponding to a predetermined speed (for example, the first speed). In addition, when the shift switching valve 33 is set to be in the second position 33*b*, the pressure of the operation fluid acting on the switching valve 38*b* is set to a pressure (an acceleration pressure) corresponding to the speed (the second speed) faster than the predetermined speed (the first speed).

Thus, when the shift switching valve 33 is in the first position 33*a*, the switching valve 38*b* is in the first position 39*a*. Accordingly, the swash plate switching cylinder 38*a* is shortened and the HST motor 36 can be set to be in the first speed.

In addition, when the shift switching valve 33 is in the second position 33*b*, the switching valve 38*b* is in the second position 39*b*. Accordingly, the swash plate switching cylinder 38*a* is stretched and the HST motor 36 can be set to be in the second speed. The HST motor 36 is shifted between the first speed and the second speed under the control of the control device 90. For example, the control device 90 is provided with an operation member 58 such as a switch (a shift switch).

When the operation member 58 is switched to the first speed, the control device 90 outputs a control signal for demagnetizing the solenoid of the shift switching valve 33 to set the shift switching valve 33 to be in the first position 33*a*. In addition, when the operation member 58 is switched to the second speed, the control device 90 outputs a control signal for magnetizing the solenoid of the shift switching valve 33 to set the shift switching valve 33 to be in the second position 33*b*.

In addition, the first traveling motor mechanism 31L includes a brake mechanism 30. The brake mechanism 30 is configured to brake the traveling device 5 arranged on the right, that is, to stop the revolving of the output shaft that revolves in synchronization with the revolving of the HST motor 36 ort the rotation of the HST motor 36.

The brake mechanism 30 is shifted to an operation state in which the traveling motor mechanism 31 is braked or to another operation state in which the brake is released by the pilot fluid (the operation fluid) outputted from the first hydraulic pump P1. For example, the brake mechanism 30 includes a first disk provided on the output shaft of the traveling motor mechanism 31, a second disk configured to move, and a spring that pushes the second disk toward the first disk to be in contact with the first disk.

In addition, the brake mechanism 30 includes a housing portion (a housing case) 159 that houses the first disk, the second disk, and the spring. A portion housing the second disk in the housing portion 59 and the brake switching valve 80*a* are connected by a fluid tube as will be described later.

The brake switching valve 80*a* is an electromagnetic valve configured to perform the braking and the releasing of braking (the brake releasing) in the brake mechanism 30, and is a two-position switching valve configured to be switched between the first position 80*a*1 and the second position 80*a*2.

When the brake switching valve 80*a* is in the first position 80*a*1, the brake switching valve 80*a* sets the pressure of the operation fluid that acts on the brake mechanism 30 (a pressure that acts on the housing portion 59) to be a pressure (a braking pressure) at which the brake mechanism 30 performs the braking. In addition, when the brake switching valve 80*a* is in the second position 80*a*2, the brake switching valve 80*a* sets the pressure of the operation fluid to be equal to or higher than the pressure (the releasing pressure) at which the performs the brake releasing.

Note that the switching of the brake switching valve 80*a* is performed under the control of the control device 90. For example, a control signal for demagnetizing the solenoid of the brake switching valve 80*a* is outputted to the control device 90, and thereby the brake switching valve 80*a* is set to be in the first position 80*a*1. In addition, the control device 90 outputs a control signal for magnetizing the solenoid of the brake switching valve 80*a* to set the brake switching valve 80*a* to the second position 80*a*2.

In addition, the outputting of the control signal from the control device 90 to the brake switching valve 80*a* may be performed, for example, by a switch and manually operating a switch preliminarily provided, or the outputting of the control signal may be performed automatically by the control device 90 that judges the operation status of the working machine.

Thus, when the brake switching valve 80*a* is in the first position 80*a*1, the pilot fluid in the housing portion of the housing portion 59 is discharged, the second disk moves in the braking direction, and thereby the braking can be performed by the brake mechanism 30.

In addition, when the brake switching valve 80*a* is in the second position 80*a*2, the pilot fluid is supplied to the housing portion of the housing portion 59, and the second disk moves to the side opposite to the braking (the side opposite to a pushing direction of the spring) to release the braking in the brake mechanism 30.

The second traveling motor mechanism 31R has the same configuration as that of the first traveling motor mechanism 31L, and the configuration shown in the first traveling motor mechanism 31L can be read as the second traveling motor 31R. Thus, the explanation of the second traveling motor 31R will be omitted.

As shown in FIG. 1, the working machine 1 includes an operation device 53. The operation device 53 is a device configured to operate the traveling device 5, that is, the first traveling motor mechanism 31L, the second traveling motor mechanism 31R, and the traveling drive mechanism 34. The operation device 53 includes an operation member 54 and a plurality of traveling operation valves 55 (55*a*, 55*b*, 55*c*, and 55*d*).

The operation member 54 is an operation member that is supported by the traveling operation valve 55 and is swung in the left-right direction (in the machine width direction) or in the front-rear direction. In addition, the plurality of traveling operation valves 55 are operated in common, that is, operated by a single of the operation member 54. The plurality of traveling operation valves 55 operate based on the swinging of the operation member 54.

The operation fluid (the pilot fluid) from the first hydraulic pump P1 can be supplied to the plurality of traveling operation valves 55 through the output fluid tube 40. The plurality of traveling operation valves 55 include a traveling operation valve 55*a*, a traveling operation valve 55*b*, a traveling operation valve 55*c*, and a traveling operation valve 55*d*.

The plurality of traveling operation valves 55 and the traveling driving mechanism 34 (the HST pumps 52L and 52R) are connected by a traveling fluid tube 45. The traveling fluid tube 45 includes a first traveling fluid tube 45*a*, a second traveling fluid tube 45*b*, a third traveling fluid tube 45*c*, a fourth traveling fluid tube 45*d*, and a fifth traveling fluid tube 45*e*. The first traveling fluid tube 45*a* is a fluid tube connected to the forward-traveling pressure receiving portion 52*a* of the HST pump 52L.

The second traveling fluid tube 45*b* is a fluid tube connected to the backward-traveling pressure receiving portion 52*b* of the HST pump 52L. The third traveling fluid tube 45*c* is a fluid tube connected to the forward-traveling pressure receiving portion 52*a* of the HST pump 52R. The fourth traveling fluid tube 45*d* is a fluid tube connected to the backward-traveling pressure receiving portion 52*b* of the HST pump 52R.

The fifth traveling fluid tube 45*e* is a fluid tube connecting between the traveling operation valve 55, the first traveling fluid tube 45*a*, the second traveling fluid tube 45*b*, the third traveling fluid tube 45*c*, and the fourth traveling fluid tube 45*d*. The fifth traveling fluid tube 45*e* connects a plurality of shuttle valves 46 and a plurality of traveling operation valves 55 (55*a*, 55*b*, 55*c*, and 55*d*).

When the operation member 54 is swung forward (in the direction of arrowed line A1 in FIG. 1), the traveling operation valve 55*a* is operated to output the pilot pressure from the traveling operation valve 55*a*, then the output shaft of the HST motor 36 revolves forward (the forward-traveling revolving) at a speed in proportion to the swinging extent of the operation member 54, and thereby the working machine 1 travels straight forward.

In addition, when the operation member 54 is swung backward (in the direction of arrowed line A2 in FIG. 1), the traveling operation valve 55*b* is operated to output the pilot pressure from the traveling operation valve 55*b*, then the output shaft of the HST motor 36 revolves backward (the backward-traveling revolving) at a speed in proportion to the swinging extent of the operation member 54, and thereby the working machine 1 travels straight backward.

In addition, when the operation member 54 is swung to the right (in the direction of arrowed line A3 in FIG. 1), the traveling operation valve 55*c* is operated to output the pilot pressure from the traveling operation valve 55*c*, then the output of the HST motor 36 arranged to the left revolves forward and the output of the HST motor 36 arranged to the right revolves backward, and thereby the working machine 1 turns to the right.

In addition, when the operation member 54 is swung to the left (in the direction of arrowed line A4 in FIG. 1), the traveling operation valve 55*d* is operated to output the pilot pressure from the traveling operation valve 55*d*, then the output of the HST motor 36 arranged to the left revolves backward and the output of the HST motor 36 arranged to the right revolves forward, and thereby the working machine 1 turns to the left.

Moreover, when the operation member 54 is swung obliquely, the revolving directions and the revolving speeds of the output shafts of the HST motor 36 on the left side and the HST motor 36 on the right side are determined by the differential pressure between the pilot pressures acting on the pressure receiving portion 52*a* and the pressure receiving portion 52*b*. Then, the working machine 1 turns right or left while moving forward or backward.

As shown in FIG. 1, an anti-stall proportional valve 81*b* is connected to the output fluid tube 40. The anti-stall proportional valve 81*b* is a proportional valve that is configured to be varied between the maximum position where the opening aperture is the maximum and the minimum position where the opening aperture is the minimum. When the anti-stall proportional valve 81*b* is at the maximum position, the anti-stall proportional valve 81*b* applies the maximum pressure of the pilot fluid to a section 40*a* of the output fluid tube 40, the section 40*a* extending from the anti-stall proportional valve 81*b* to the plurality of traveling operation valves 55 (55*a*, 55*b*, 55*c*, and 55*d*). When the anti-stall proportional valve 81*b* is at the minimum position, the anti-stall proportional valve 81*b* applies the minimum pressure of the pilot fluid to the section 40*a*. The anti-stall proportional valve 81*b* performs the control (the anti-stall control) for preventing the engine stall.

Figure 4:
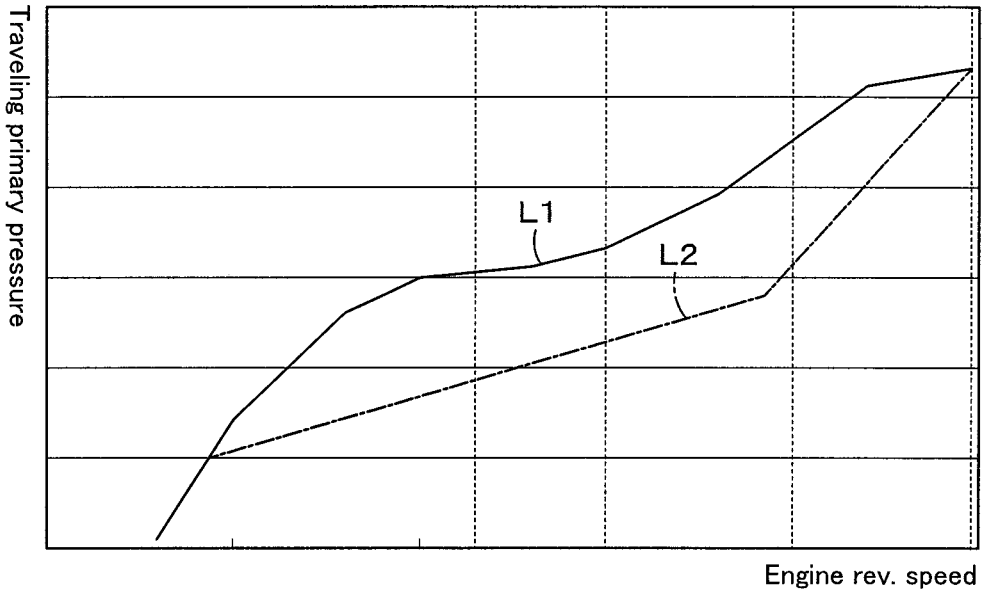
FIG. 4 is a view illustrating a relation between an engine revolving speed, a traveling primary pressure, and control lines L1 and L2 according to the embodiment.

FIG. 4 shows a relation between the engine speed, the traveling primary pressure, and the control lines L1 and L2. The traveling primary pressure is the pressure of operation fluid (the pilot pressure) in the section of the output fluid tube 40, the section extending from the anti-stall proportional valve 81*b* to the traveling operation valve 55 (55*a*, 55*b*, 55*c*, and 55*d*).

That is, the pressure of the operation fluid is the primary pressure of the operation fluid that enters the traveling operation valve 55 provided in the operation member 54.

The control line L1 shows the relation between the engine speed and the traveling primary pressure in the case where the dropping amount is less than a predetermined amount. The control line L2 shows the relation between the engine speed and the traveling primary pressure in the case where the dropping amount is larger than or equal to the predetermined amount.

When the dropping amount is less than the predetermined value, the control device 90 adjusts the opening aperture of the anti-stall proportional valve 81*b* so that the relationship between the actual engine speed and the traveling primary pressure matches with the control line L1. In addition, when the dropping amount is greater than or equal to the predetermined amount, the control device 90 adjusts the opening aperture of the anti-stall proportional valve 81*b* so that the relationship between the actual engine speed and the traveling primary pressure matches with the control line L2.

In the control line L2, the traveling primary pressure corresponding to a predetermined engine speed is lower than the traveling primary pressure of the control line L1. That is, paying attention to the identical engine speed, the traveling primary pressure of the control line L2 is lower than the traveling primary pressure of the control line L1.

Thus, the pressure (the pilot pressure) of the operation fluid flowing into the traveling operation valve 55 is kept low under the control based on the control line L2.

As the result, the swash plate angle of the HST pump (the traveling pump) 52 is adjusted, the load acting on the engine is reduced, and thereby the engine stall can be prevented. A single of control line L2 is shown in FIG. 4. However, a plurality of control lines L2 may be employed.

For example, the control line L2 may be employed for each engine speed. In addition, it is preferred for the control device 90 to have the data indicating the control lines L1 and L2, or the control parameters such as functions.

The hydraulic system for the working machine 1 includes the first hydraulic device configured to supply the pilot fluid, the first actuator valve configured to control the pilot fluid supplied to the first hydraulic device, a second hydraulic device configured to supply the pilot fluid, a plurality of second actuator valves configured to control the pilot fluid supplied to the second hydraulic device, and a third actuator valve provided in the output fluid tube connecting between the pilot pump and the plurality of second actuator valves.

In the embodiment, the first hydraulic device is the brake mechanism 30, the first actuator valve is the brake switching valve 80*a*, the second hydraulic device is the HST pumps (the traveling pumps) 52L and 52R, the plurality of second actuator valves are the plurality of traveling operation valves 55 (55*a*, 55*b*, 55*c*, and 55*d*), and the third actuator valve is the anti-stall proportional valve 81*b*.

The anti-stall proportional valve 81*b* has a primary port (a pump port) 81*b*1 and a secondary port 81*b*2. The primary port 81*b*1 of the anti-stall proportional valve 81*b* is connected to the output fluid tube 40 arranged on the first hydraulic pump (the pilot pump) P1 side.

The secondary port 81*b*2 of the anti-stall proportional valve 81*b* is connected to the section 40*a* arranged on the operation device 53 side. The discharge port 81*b*3 of the anti-stall proportional valve 81*b* is connected to a discharge portion of the operation fluid tank 22 or the like through the discharge fluid tube 67.

The brake mechanism 30 and the brake switching valve 80*a* are connected by the operation fluid tube 61. In the embodiment, the operation fluid tube 61 includes a first braking fluid tube 61*a* and a second braking fluid tube 61*b*. The first braking fluid tube 61*a* is a fluid tube that connects the brake mechanism 30 of the first traveling motor mechanism 31L and the brake switching valve 80*a*. The second braking fluid tube 61*b* is a fluid tube that connects the braking mechanism 30 of the second traveling motor mechanism 31R and the brake switching valve 80*a*.

The first braking fluid tube 61*a* and the second braking fluid tube 61*b* are connected in the middle, and a shared fluid tube 61*c* after the connecting (a fluid tube shared with the first braking fluid tube 61*a* and the second braking fluid tube 61*b*) is connected to the brake switching valve 80*a*.

Thus, when the brake switching valve 80*a* is in the second position (an applied position) 80*a*2, the pressure of the pilot fluid is applied to the operation fluid tube (the first braking fluid tube 61*a*, the second braking fluid tube 61*b*, and the shared fluid tube 61*c*). In addition, when the brake switching valve 80*a* is in the first position (a pressure-reducing position) 80*a*1, the pressure of the pilot fluid in the operation fluid tube (the first braking fluid tube 61*a*, the second braking fluid tube 61*b*, and the shared fluid tube 61*c*) is reduced.

In the output fluid tube 40, one end of the branched fluid tube 63 is connected to the section 40*a* connecting between the anti-stall proportional valve (the third actuator valve) 81*b* and the plurality of traveling operation valves 55 (the plurality of second actuator valves). The other end of the branched fluid tube 63 is connected to the shared fluid tube 61*c* of the operation fluid tube 61.

In particular, the operation fluid tube 61 (the shared fluid tube 61*c*) is provided with a branched portion 65, and the section 40*a* of the output fluid tube 40 is provided with a branched portion 64. The branched portion 65 and the branched portion 64 are connected to the branched fluid tube 63.

In this manner, the brake switching valve 80*a* and the anti-stall proportional valve 81*b* are connected by the branched fluid tube 63. As described later, the pilot fluid can be circulated through the branched fluid tube 63 by the brake switching valve 80*a* and the anti-stall proportional valve 81*b*.

The traveling fluid tube 45 (the first traveling fluid tube 45*a*, the second traveling fluid tube 45*b*, the third traveling fluid tube 45*c*, the fourth traveling fluid tube 45*d*) and the branched fluid tube 63 extend through the relay device 200. In this manner, the heat exchanging between the pilot fluid flowing through the traveling fluid tube 45 and the pilot fluid flowing through the branched fluid tube 63 is achieved.

Figure 2:
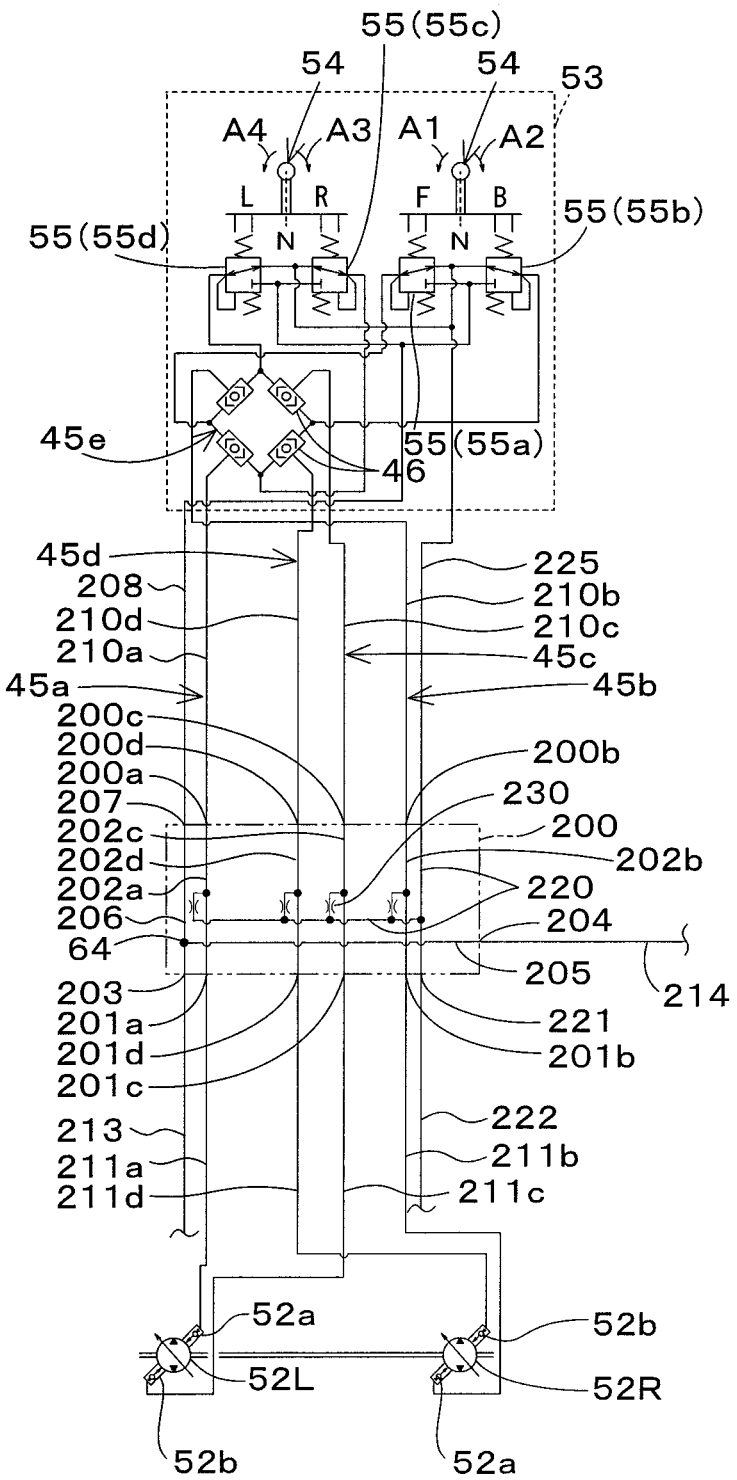
FIG. 2 is an enlarged view illustrating the hydraulic system around a relay device according to the embodiment.
Figure 6:
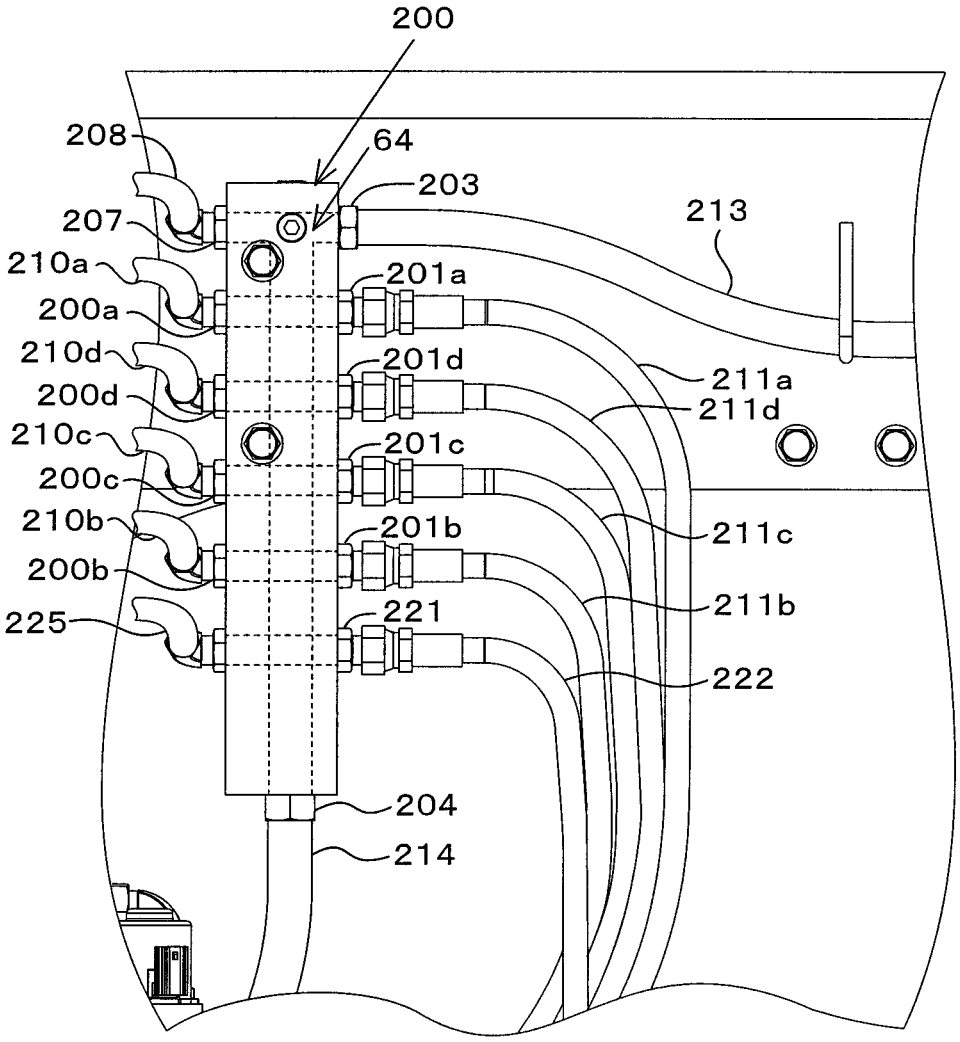
FIG. 6 is a view illustrating an appearance of the relay device according to the embodiment.

As shown in FIG. 2 and FIG. 6, the relay device 200 is formed of, for example, a casting iron, and has flow lines and the like formed therein. The relay device 200 is attached to the frame of the working machine 1. The relay device 200 includes a plurality of input ports 200*a*, 200*b*, 200*c*, and 200*d*, a plurality of output ports 201*a*, 201*b*, 201*c*, and 201*d*, a plurality of first flow lines 202*a*, 202*b*, 202*c*, and 202*d*, a main port 203, a branched port 204, and a second flow line 205.

The first flow line 202*a* is a flow path that connects between the input port 200*a* and the output port 201*a*. The first flow line 202*b* is a flow path that connects between the input port 200*b* and the output port 201*b*. The first flow line 202*c* is a flow path that connects between the input port 200*c* and the output port 201*c*. The first flow line 202*d* is a flow path that connects between the input port 200*d* and the output port 201*d*.

The second flow line 205 is a flow path that connects between the main port 203 and the branched port 204, and is a flow path provided extending over the plurality of the first flow lines 202*a*, 202*b*, 202*c*, and 202*d*. In particular, the plurality of first flow lines 202*a*, 202*b*, 202*c*, and 202*d* extend across the second flow line 205. The plurality of first flow lines 202*a*, 202*b*, 202*c* and 202*d* extend in the longitudinal direction of the relay device 200, and the second flow line 205 extends in the lateral direction of the relay device 200.

The plurality of first flow lines 202*a*, 202*b*, 202*c*, and 202*d* are arranged offset from the second flow line 205 in the thickness direction. In addition, the relay device 200 is provided with the third flow line 206 that branches from the second flow line 205, and the port 207 is connected to the third flow line 206.

A plurality of input pipe members 210*a*, 210*b*, 210*c*, and 210*d* are connected to the relay device 200. The plurality of input pipe members 210*a*, 210*b*, 210*c*, and 210*d* are pipe members connected respectively to the plurality of traveling operation valves 55 (55*a*, 55*b*, 55*c*, 55*d*), and are configured to supply the pilot fluid outputted from the plurality of traveling operation valves 55 (55*a*, 55*b*, 55*c*, 55*d*).

One end of the input pipe 210*a* is connected to the output port of the operation device 53, and the other end is connected to the input port 200*a*. One end of the input pipe 210*b* is connected to the output port of the operation device 53, and the other end is connected to the input port 200*b*.

One end of the input pipe 210*c* is connected to the output port of the operation device 53, and the other end is connected to the input port 200*c*. One end of the input pipe member 210*d* is connected to the output port of the operation device 53, and the other end is connected to the input port 200*d*.

A plurality of output pipe members 211*a*, 211*b*, 211*c*, and 211*d* are connected to the relay device 200. One end of the output tube 211*a* is connected to the output port 201*a*, and the other end is connected to the pressure receiving portion 52*a* of the HST pump 52L. One end of the output tube 211*b* is connected to the output port 201*b*, and the other end is connected to the pressure receiving portion 52*a* of the HST pump 52R.

One end of the output pipe 211*c* is connected to the output port 201*c*, and the other end is connected to the pressure receiving part 52*b* of the HST pump 52L. One end of the output tube 211*d* is connected to the output port 201*d*, and the other end is connected to the pressure receiving portion 52*b* of the HST pump 52R.

A main pipe 213 is connected to the relay device 200. One end of the main pipe 213 is connected to the anti-stall proportional valve 81*b*, and the other end is connected to the main port 203.

A branched pipe member 214 is connected to the relay device 200. The branched pipe member 214 is a pipe constituting at least a part of the branched fluid tube 63. One end of the branched pipe member 214 is connected to the branched port 204, and the other end is connected to the branched portion 65.

As shown in FIG. 1, the check valve 217 is provided in the middle of the branched pipe member 214. The check valve 217 is a valve configured to allow the pilot fluid to flow from the branched port 204 side toward the branched portion 65 and to prevent the pilot fluid from flowing from the branched portion 65 side toward the branched port 204 side.

In addition, the branched pipe member 214 has the bypass pipe 218 that forms a bypass fluid tube, and the bypass pipe 218 is connected to both sides of the check valve 217.

As shown in FIG. 2, the relay device 200 is provided with the third flow line 206 that branches from the second flow line 205, and the port 207 is connected to the third flow line 206. The supply pipe member 208 that supplies the pilot fluid from the pump side to the plurality of traveling operation valves 55 (55*a*, 55*b*, 55*c*, 55*d*) is connected to the port 207.

According to the above configuration, the traveling fluid tubes 45 (the first traveling fluid tube 45*a*, the second traveling fluid tube 45*b*, the third traveling fluid tube 45*c*, and the fourth traveling fluid tube 45*d*) are constituted of the plurality of first flow lines 202*a*, 202*b*, 202*c*, and 202*d*, the plurality of input pipes 210*a*, 210*b*, 210*c*, and 210*d*, and the plurality of output pipes 211*a*, 211*b*, 211*c*, and 211*d*. In addition, the branched fluid tube 63 is constituted of the second flow line 205 and the branched pipe member 214.

The relay device 200 includes the air-releasing line 220. The air-releasing line 220 is a channel that branches from each of the plurality of first flow lines 202*a*, 202*b*, 202*c*, and 202*d*, and are connected to each other in the middle. The air-releasing line 220 is connected to the drain port 221 formed in the relay device 200. The air-releasing line 220 is provided with the throttle portion 230 for reducing the flow rate.

One end of the drain pipe member 222 that discharges the pilot fluid is connected to the drain port 221. The other end of the drain pipe member 222 is connected to the discharge portion that discharges the pilot fluid. The discharge portion is connected to the operation fluid tank, the suction portion of the first hydraulic pump (the pilot pump) P1, or the like.

Note that the drain port is formed in the operation device 53, and the drain port of the operation device 53 and the air-releasing line 220 are connected with each other through the drain port and the drain pipe material 225.

Figure 3:
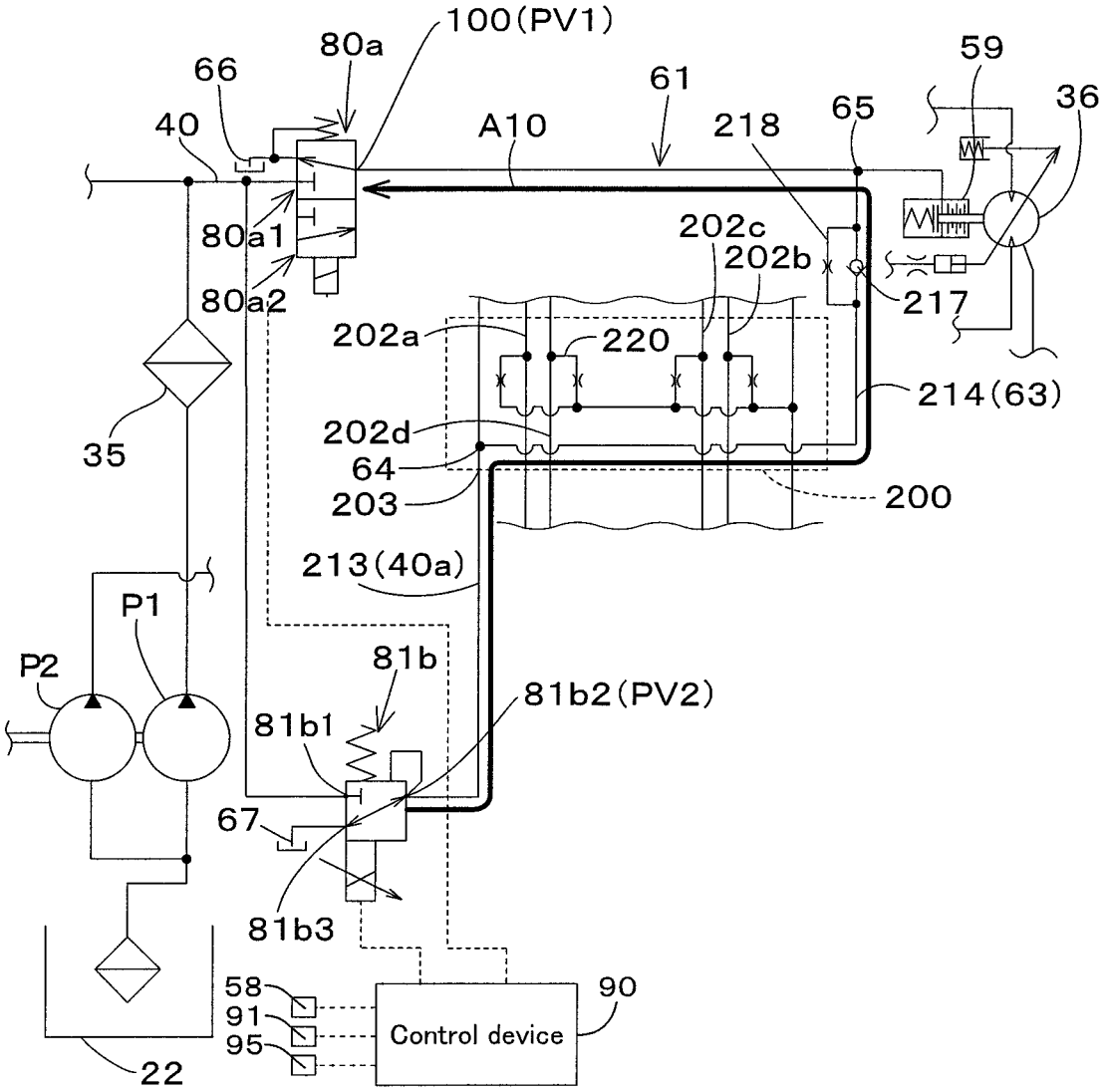
FIG. 3 is a view illustrating flow of pilot fluid according to the embodiment.

The control device 90 is configured to be switched to be in the warm-up mode, and is configured to warm up the pilot fluid in the warm-up mode. As shown in FIG. 3, the mode switch 95 configured to be switched between ON and OFF is connected to the control device 90, and in the warm-up mode, the warm-up mode is established when the mode switch 95 is ON, and the warm-up mode is canceled when the mode switch 95 is OFF.

In the warm-up mode, the control device 90 warms up the pilot fluid by controlling the brake switching valve 80*a* and the anti-stall proportional valve 81*b*. As described above, when the warm-up mode is not set, the control device 90 performs the anti-stall control based on the engine speed under the state where the brake switching valve 80*a* is in the second position (the applied position) 80*a*2.

When the control device 90 enters the warm-up mode, the control device 90 sets a differential pressure between the brake set pressure (a first set pressure) PV1 set by the brake switching valve 80*a* and the set pressure (a second set pressure) PV2 set by the anti-stall proportional valve 81*b*. The brake set pressure (the first set pressure) PV1 is, for example, a pressure of the output port 100 of the brake switching valve 80*a*.

In other words, the first set pressure PV1 is a pressure that acts on the operation fluid tube 61 (the first braking fluid tube 61*a*, the second braking fluid tube 61*b*, and the shared fluid tube 61*c*).

The second set pressure (the set pressure) PV2 is, for example, a pressure of the output port 101 of the secondary port 81*b*2 of the anti-stall proportional valve 81*b*. In other words, the second set pressure PV2 is a pressure acting on the section 40*a* of the output fluid tube 40.

The control device 90 controls the brake switching valve 80*a* and the anti-stall proportional valve 81*b* so that a differential pressure between the first set pressure PV1 and the second set pressure PV2 is generated. For example, when the control device 90 is in the warm-up mode in which the warm-up is performed, the control device 90 reduces the first set pressure PV1 of the brake switching valve 80*a* to be lower than the set pressure PV2 of the anti-stall proportional valve 81*b*.

In other words, when the control device 90 is in the warm-up mode, the control device 90 increases the set pressure PV2 of the anti-stall proportional valve 81*b* to be higher than the first set pressure PV1 of the brake switching valve 80*a*.

In particular, in the warm-up mode, the control device 90 sets the brake switching valve 80*a* to the first position (the pressure-reducing position) 80*a*1, and thereby setting the first set pressure PV1 to be a braking pressure at which the braking mechanism 30 performs the braking. In addition, in the warm-up mode, the control device 90 sets the anti-stall proportional valve 81*b* to be in the maximum position, and thereby increasing the set pressure PV2 to be higher than the first set pressure PV1.

That is, when the brake switching valve 80*a* is in a braking state and further when the anti-stall proportional valve 81*b* is at the maximum position, the first set pressure PV1 is smaller than the set pressure PV2, and the set pressure PV2 set by the anti-stall proportional valve 81*b* is higher than the first set pressure PV1 of the operation fluid set by the brake switching valve 80*a*.

In other words, when the brake switching valve 80*a* is at the first position (the pressure-reducing position) 80*a*1, the anti-stall proportional valve 81*b* increases a pressure of the pilot fluid pressure applied to the section 40*a* of the output fluid tube 40 to be higher than a pressure applied to the operation fluid tube 61 at the first position (the pressure-reducing position) 80*a*1.

In the above-described embodiment, the set pressure PV2 is set to be higher than the first set pressure PV1 by setting the anti-stall proportional valve 81*b* to the maximum position. However, when the first set pressure PV1 is smaller than the set pressure PV2, the anti-stall proportional valve 81*b* may be at another position other than the maximum position (the maximum pressure), that is, may be at a position (a pressure) lower than the maximum position (the maximum pressure).

As shown by an arrowed line A10 in FIG. 3, when the first set pressure PV1 is smaller than the set pressure PV2, the operation fluid that has flowed through the anti-stall proportional valve 81*b* flows to the second flow line 205 and the branched pipe member 214 of the relay device 200. And then, the operation fluid is discharged from the discharge port of the brake switching valve 80*a* to the discharge fluid tube 66.

As the result, the pilot fluid outputted from the first hydraulic pump (the pilot pump) P1 flows through the second flow line 205 and the branched pipe member 214 of the relay device 200, and returns from the discharge port of the brake switching valve 80*a* to the first hydraulic pump (the pilot pump) P1 side. In this manner, the pilot fluid on the primary side can be circulated, so that the pilot fluid is warmed up.

Here, when the operation member 54 or the like is operated to operate the traveling operation valves 55*a*, 55*b*, 55*c*, and 55*d*, the pilot fluid on the secondary side of the traveling operation valves 55*a*, 55*b*, 55*c*, and 55*d* flows to the plurality of input pipe members 210*a*, 210*b*, 210*c*, and 210*d*, to the plurality of first flow lines 202*a*, 202*b*, 202*c*, and 202*d*, and to the plurality of output tubes 211*a*, 211*b*, 211*c*, and 211*d*.

Thus, the heat exchanging between the pilot fluid on the secondary side that has flowed through the plurality of first flow lines 202*a*, 202*b*, 202*c*, and 202*d* of the relay device 200 and the pilot fluid on the primary side that flows to the second flow line 205 of the relay device 200 is achieved through the relay device 200, and thus the pilot fluid on the secondary side is warmed up.

For example, the mode switch 95 configured to be switched between ON and OFF is connected to the control device 90, and in the warm-up mode, the warm-up mode is established when the mode switch 95 is ON, and the warm-up mode is canceled when the mode switch 95 is OFF. As described above, when the warm-up mode is not set, the control device 90 performs the anti-stall control based on the engine speed under the state where the brake switching valve 80*a* is in the second position (the applied position) 80*a*2.

Figure 5:
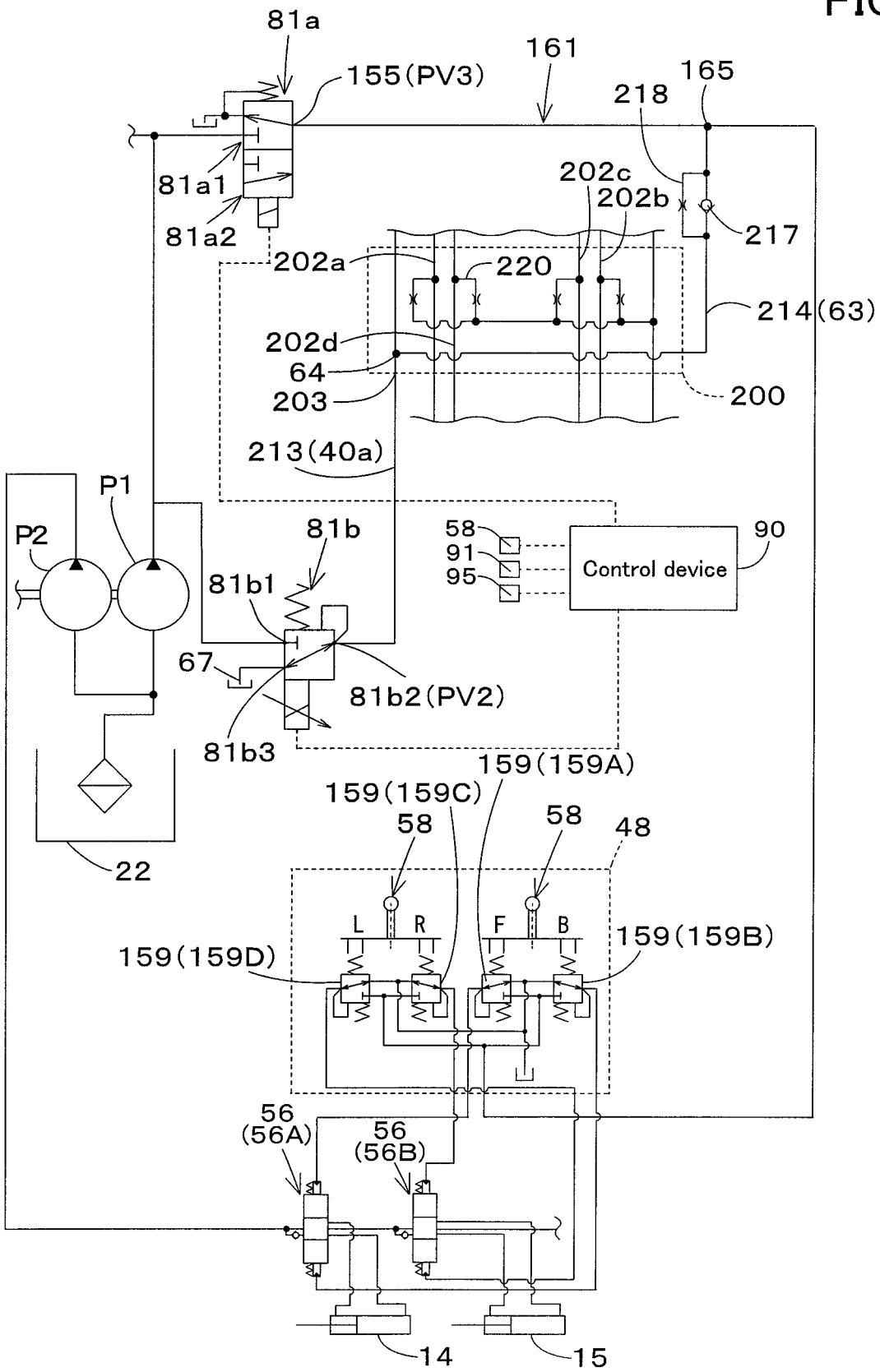
FIG. 5 is a view illustrating a modification example of the hydraulic system for the working machine according to the embodiment.

FIG. 5 shows a modification example of the hydraulic system for the working machine. In the hydraulic system of FIG. 5, the first hydraulic device is a working operation valve 159, the first actuator valve is a hydraulic-locking switching valve 81*a*, the second hydraulic device is the HST pumps (the travel pumps) 52L and 52R, the plurality of second valves are the plurality of traveling operation valves 55 (55*a*, 55*b*, 55*c*, and 55*d*), and the third actuator valve is the anti-stall proportional valve 81*b*.

The working operation valve 159 and the hydraulic-locking switching valve 81*a* are connected by the operation fluid tube 161. The operation fluid tube 161 is provided with the branched portion 165, and the branched pipe member 214 constituting a part of the branched fluid tube 63 is connected to the branched portion 165.

The hydraulic-locking switching valve 81*a* is a valve capable of stopping the pilot fluid to be supplied to the operation device 48 (the working operation valves 159A, 159B, 159C, and 159D). The hydraulic-locking switching valve 81*a* is a two-position switching valve configured to be switched between the first position 81*a*1 and the second position 81*a*2.

When the hydraulic-locking switching valve 81*a* is set to the first position 81*a*1, the pilot fluid from the first hydraulic pump P1 is not supplied to the working operation valves 159A, 159B, 159C, and 159D, and established is the locked state where a pressure of the operation fluid by the working operation valves 159A, 159B, 159C, and 159D is not applied to the pressure receiving portions of the plurality of control valves 56 even when the operation member 58 is operated.

When the hydraulic-locking switching valve 81*a* is set to the second position 81*a*2, established in the locking-releasing state where the pilot fluid from the first hydraulic pump P1 is supplied to the working operation valves 159A, 159B, 159C, and 159D, and where a pressure of the pilot fluid by the valves 159A, 159B, 159C, and 159D is applied to the plurality of control valves 56 in accordance with the operation of the operation member 58.

Since the configurations of the working operation valves 159A, 159B, 159C, and 159D is the same as the configurations of the traveling operation valves 55*a*, 55*b*, 55*c*, and 55*d*, the description thereof is omitted.

The plurality of control valves 56 include the boom control valve 56A and the bucket control valve 56B. The boom control valve 56A is a valve configured to control the hydraulic cylinder (the boom cylinder) 14 that controls the boom 10. The bucket control valve 56B is a valve configured to control the hydraulic cylinder (the bucket cylinder) 15 that controls the bucket 11.

Each of the boom control valve 56A and the bucket control valve 56B is a direct-acting spool type three-position switching valve of pilot type. The boom control valve 56A and the bucket control valve 56B are switched between the neutral position, the first position different from the neutral position, and the second position different from the neutral position and the first position by the pilot pressure. The boom cylinder 14 is connected to the boom control valve 56A through a fluid tube, and the bucket cylinder 15 is connected to the bucket control valve 56B through a fluid tube.

When the operation member 58 is tilted forward, the pilot valve (the operation valve) 159A for the lowering is operated, and thereby the pilot pressure of the pilot fluid outputted from the working operation valve 159A for the lowering is set. This pilot pressure acts on the pressure receiving portion of the boom control valve 56A, the boom cylinder 14 is shortened, and then the boom 10 is lowed.

When the operation member 58 is tilted backward, the pilot valve (the operation valve) 159B for the lifting is operated, and thereby the pilot pressure of the pilot fluid outputted from the working operation valve 159B for the lifting is set. This pilot pressure acts on the pressure receiving portion of the boom control valve 56A, the boom cylinder 14 is stretched, and then the boom 10 is lifted.

When the operation member 58 is tilted rightward, the pilot valve (the operation valve) 159C for the bucket dumping is operated, and the pilot pressure of the pilot fluid outputted from the working operation valve 159C is set. The pilot pressure acts on the pressure receiving portion of the bucket control valve 56B, the bucket cylinder 15 is stretched, and then the bucket 11 performs the dumping operation.

When the operation member 58 is tilted leftward, the pilot valve (the operation valve) 159D for the bucket shoveling is operated, and the pilot pressure of the pilot fluid outputted from the working operation valve 159D is set. The pilot pressure acts on the pressure receiving portion of the bucket control valve 56B, the bucket cylinder 15 is shortened, and then the bucket 11 performs the shoveling operation.

In the warm-up mode, the control device 90 warms up the pilot fluid by controlling the hydraulic-locking switching valve 81*a* and the anti-stall proportional valve 81*b*. As described above, when the warm-up mode is not set, the control device 90 performs the anti-stall control based on the engine speed under the state where the brake switching valve 80*a* is in the second position (the applied position) 80*a*2.

When the control device 90 enters the warm-up mode, the control device 90 sets a differential pressure between the hydraulic-locking set pressure (the first set pressure) PV3 set by the hydraulic-locking switching valve 81*a* and the set pressure (the second set pressure) PV2 set by the anti-stall proportional valve 81*b*. The hydraulic-locking set pressure (the first set pressure) PV3 is, for example, a pressure of the output port 155 of the hydraulic-locking switching valve 81*a*. In other words, the first set pressure PV3 is a pressure acting on the operation fluid tube 161.

The control device 90 controls the hydraulic-locking switching valve 81*a* and the anti-stall proportional valve 81*b* so that the differential pressure between the first set pressure PV3 and the second set pressure PV2 is generated. For example, when the control device 90 is in the warm-up mode for performing the warm-up, the control device 90 reduces the first set pressure PV3 of the hydraulic-locking switching valve 81*a* to be lower than the second set pressure PV2 of the anti-stall proportional valve 81*b*.

In other words, when the control device 90 is in the warm-up mode, the control device 90 increases the second set pressure PV2 of the anti-stall proportional valve 81*b* to be higher than the first set pressure PV3 of the hydraulic-locking switching valve 81*a*.

In particular, when the control device 90 is in the warm-up mode, the control device 90 sets the hydraulic-locking switching valve 81*a* to be in the first position (the pressure-reducing position) 81*a*1, and thereby setting the first set pressure PV3 to a pressure at which the hydraulic locking can be achieved. In addition, in the warm-up mode, the control device 90 sets the anti-stall proportional valve 81*b* to be in the maximum position, and thereby increasing the set pressure PV2 to be higher than the first set pressure PV3.

That is, when the hydraulic-locking switching valve 81*a* is in the braking state, and the anti-stall proportional valve 81*b* is in the maximum position, the first set pressure PV3 is smaller than the set pressure PV2. The set pressure PV2 set by the anti-stall proportional valve 81*b* is higher than the first set pressure PV3 set by the hydraulic-locking switching valve 81*a*.

In other words, when the hydraulic-locking switching valve 81*a* is in the first position (the pressure-reducing position) 81*a*1, the anti-stall proportional valve 81*b* increases a pressure of the pilot fluid applied to the section 40*a* of the output fluid tube 40 to be higher than a pressure applied to the operation fluid tube 161 at the first position (the pressure-reducing position) 81*a*1.

According to the above configuration, the pilot fluid can be circulated through the operations of the hydraulic-locking switching valve 81*a* and the anti-stall proportional valve 81*b*. As shown in FIG. 1, when the traveling operation valve 55 is operated, the pilot fluid for the traveling system flows to the relay device 200. Thus, the heat exchanging between the pilot fluid for the traveling system and the pilot fluid for the working system (the pilot fluid flowing toward the hydraulic-locking switching valve 81*a*) is achieved.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a pilot pump to output pilot fluid;

a first hydraulic device to which the pilot fluid is supplied;

a first actuator valve to control the pilot fluid to be supplied to the first hydraulic device;

a second hydraulic device to which the pilot fluid is supplied;

a plurality of second actuator valves to control the pilot fluid to be supplied to the second hydraulic device;

a third actuator valve arranged in an output fluid tube connecting between the pilot pump and the plurality of second actuator valves;

an operation fluid tube connecting between the first hydraulic device and the first actuator valve;

a branched tube connected to a branched portion branching from the operation fluid tube;

a plurality of input tubes in which the pilot fluid outputted from the plurality of second actuator valves flows, the input tubes being connected to the second actuator valves;

a plurality of output tubes connected to a pressure receiver portion of the second hydraulic device;

a main tube connected to the third actuator valve;

a relay device including:

a plurality of input ports connected to the plurality of input tubes;

a plurality of output ports connected to the plurality of output tubes;

a plurality of first flow lines connecting between the plurality of input ports and the plurality of input ports;

a main port connected to the main tube;

a branched port connected to the branched tube; and a second flow line extending across the plurality of first flow lines, and connecting between the main port and the branched port.

2. The working machine according to claim 1, wherein the first actuator valve is a switching valve having:

an applying position allowing a pressure of the pilot fluid to be applied to the operation fluid tube; and a pressure-reducing position allowing the pressure of the pilot fluid in the operation fluid tube to be reduced, and wherein the third actuator valve has valve positions between:

a first position allowing the pilot fluid to be applied at a first pressure to a section of the output fluid tube between the third actuator valve and the plurality of second actuator valves; and a second position allowing the pilot fluid to be applied to the section at a second pressure lower than the first pressure.

3. The working machine according to claim 2, wherein when the first actuator valve is in the pressure-reducing position, the third actuator valve increases a pressure of pilot fluid applied to the output fluid tube to be higher than a pressure applied to the operation fluid tube at the pressure-reducing position.

4. The working machine according to claim 3, wherein the branched tube includes a check valve to allow pilot fluid to flow from the branched port side toward the branched portion and to block the pilot fluid from flowing from the branched portion toward the branched port side.

5. The working machine according to claim 3, comprising a drain tube to discharge pilot fluid, wherein the relay device includes:

air-releasing flow lines branched from the plurality of first flow lines; and a drain port connected to the drain tube and communicated with the air-releasing flow lines.

6. The working machine according to claim 3, wherein the first hydraulic device is configured to perform braking with the pilot fluid, wherein the first actuator valve is a braking actuator valve that is configured to control operation fluid to be supplied to the first hydraulic device, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

7. The working machine according to claim 3, wherein the first hydraulic device is a working operation valve that is configured to supply pilot fluid to a working control valve, wherein the first actuator valve is a hydraulic lock-switching valve having:

a position blocking the pilot fluid from being supplied to the working operation valve; and another position allowing operation fluid to be supplied to the working operation valve, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

8. The working machine according to claim 2, wherein the branched tube includes a check valve to allow pilot fluid to flow from the branched port side toward the branched portion and to block the pilot fluid from flowing from the branched portion toward the branched port side.

9. The working machine according to claim 2, comprising a drain tube to discharge pilot fluid, wherein the relay device includes:

air-releasing flow lines branched from the plurality of first flow lines; and a drain port connected to the drain tube and communicated with the air-releasing flow lines.

10. The working machine according to claim 2, wherein the first hydraulic device is configured to perform braking with the pilot fluid, wherein the first actuator valve is a braking actuator valve that is configured to control operation fluid to be supplied to the first hydraulic device, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

11. The working machine according to claim 2, wherein the first hydraulic device is a working operation valve that is configured to supply pilot fluid to a working control valve, wherein the first actuator valve is a hydraulic lock-switching valve having:

a position blocking the pilot fluid from being supplied to the working operation valve; and another position allowing operation fluid to be supplied to the working operation valve, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

12. The working machine according to claim 1, wherein the branched tube includes a check valve to allow pilot fluid to flow from the branched port side toward the branched portion and to block the pilot fluid from flowing from the branched portion toward the branched port side.

13. The working machine according to claim 12, comprising a drain tube to discharge pilot fluid, wherein the relay device includes:

air-releasing flow lines branched from the plurality of first flow lines; and a drain port connected to the drain tube and communicated with the air-releasing flow lines.

14. The working machine according to claim 12, wherein the first hydraulic device is configured to perform braking with the pilot fluid, wherein the first actuator valve is a braking actuator valve that is configured to control operation fluid to be supplied to the first hydraulic device, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

15. The working machine according to claim 12, wherein the first hydraulic device is a working operation valve that is configured to supply pilot fluid to a working control valve, wherein the first actuator valve is a hydraulic lock-switching valve having:

a position blocking the pilot fluid from being supplied to the working operation valve; and another position allowing operation fluid to be supplied to the working operation valve, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

16. The working machine according to according to claim 1, comprising a drain tube to discharge pilot fluid, wherein the relay device includes:

air-releasing flow lines branched from the plurality of first flow lines; and a drain port connected to the drain tube and communicated with the air-releasing flow lines.

17. The working machine according to claim 16, wherein the first hydraulic device is configured to perform braking with the pilot fluid, wherein the first actuator valve is a braking actuator valve that is configured to control operation fluid to be supplied to the first hydraulic device, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

18. The working machine according to claim 16, wherein the first hydraulic device is a working operation valve that is configured to supply pilot fluid to a working control valve, wherein the first actuator valve is a hydraulic lock-switching valve having:

a position blocking the pilot fluid from being supplied to the working operation valve; and another position allowing operation fluid to be supplied to the working operation valve, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

19. The working machine according to according to claim 1, wherein the first hydraulic device is configured to perform braking with the pilot fluid, wherein the first actuator valve is a braking actuator valve that is configured to control operation fluid to be supplied to the first hydraulic device, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

20. The working machine according to according to claim 1, wherein the first hydraulic device is a working operation valve that is configured to supply pilot fluid to a working control valve, wherein the first actuator valve is a hydraulic lock-switching valve having:

a position blocking the pilot fluid from being supplied to the working operation valve; and another position allowing operation fluid to be supplied to the working operation valve, wherein the second hydraulic device is a traveling pump that is configured to change power due to the pilot fluid, wherein the second actuator valve is a traveling operation valve that is configured to change a flow rate of the pilot fluid to be supplied to the traveling pump in accordance with operation of an operation member, and wherein the third actuator valve is an anti-stall proportional valve that is configured to change a pressure of pilot fluid to be supplied to the traveling operation valve based on a revolving speed of a prime mover.

* * * * *